US006481215B1

(12) United States Patent
Ikegami et al.

(10) Patent No.: US 6,481,215 B1
(45) Date of Patent: Nov. 19, 2002

(54) SEALING DEVICE FOR GAS COMPRESSOR-EXPANDER

(75) Inventors: Kazuo Ikegami; Mitsuhiro Masuda; Hiroyuki Suzuki, all of Moriguchi (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/462,742

(22) PCT Filed: Jul. 3, 1998

(86) PCT No.: PCT/JP98/03022

§ 371 (c)(1),
(2), (4) Date: Feb. 15, 2000

(87) PCT Pub. No.: WO99/04205

PCT Pub. Date: Jan. 28, 1999

(30) Foreign Application Priority Data

Jul. 16, 1997 (JP) ..... 9-191411
Sep. 30, 1997 (JP) ..... 9-267148
Jan. 13, 1998 (JP) ..... 10-004805

(51) Int. Cl.[7] ..... F25B 9/00; F01B 29/10
(52) U.S. Cl. ..... 62/6; 60/520
(58) Field of Search ..... 62/6; 60/520

(56) References Cited

U.S. PATENT DOCUMENTS 4,282,716 A * 8/1981 Momose et al. ..... 62/6

FOREIGN PATENT DOCUMENTS

| | | |
|---|---|---|
| JP | 64-87854 | * 3/1989 |
| JP | 6-249064 | * 9/1994 |
| JP | 6-323671 | * 11/1994 |
| JP | 7-151404 | * 6/1995 |
| JP | 9-292162 | * 11/1997 |

* cited by examiner

*Primary Examiner*—William Doerrler
(74) *Attorney, Agent, or Firm*—Armstrong, Westerman, Hattori, McLeland & Naughton, LLP

(57) ABSTRACT

In a gas compressor-expander according to the invention, a partition wall 19 between a space 21 in the rear of a piston and a crank chamber 12 has a piston rod 22 slidably extending therethrough and a seal device 9 surrounding the piston rod 22. The seal device 9 comprises a first seal member 93 having a high sealing property against a flow from the crank chamber 12 toward the space 21, an intermediate chamber 91 provided in the vicinity of the first seal member 93 at one side thereof toward the space, a second seal member 95 disposed in the vicinity of the intermediate chamber 91 at one side thereof toward the space, and a communication channel 96 for holding the intermediate chamber 91 and the crank chamber 12 in communication with each other. This construction gives a prolonged life to the seal device and prevents impairment of the refrigeration capacity of the gas compressor-expander.

10 Claims, 9 Drawing Sheets

12

SEALING DEVICE FOR GAS COMPRESSOR-EXPANDER

TECHNICAL FIELD

The present invention relates to gas compressor-expanders wherein power is generated or refrigeration is effected utilizing the compression and/or expansion of a gas as in Stirling engines or Stirling chillers, and more particularly to gas compressor/expanders having a seal device for preventing lubricating oil from ingressing into a working space wherein a gas is compressed or expanded.

BACKGROUND ART

The fields of cutting-edge technologies, such as biotechnology and electronic devices, in recent years involve a pressing need to develop techniques for preserving various samples of materials at cryogenic temperatures. Attention has been directed especially to gas compressor/expanders, such as Stirling chillers, as means for realizing cryogenic temperatures for wide use in coolers for infrared sensors or superconductive devices, biomedical freezers or chillers, etc.

Such compressor/expanders comprise a piston or displacer (hereinafter referred to collectively as the "piston") housed in a cylinder, connected to a piston rod and reciprocatingly movable within the cylinder for compressing and/or expanding a working gas, provided around the piston rod is a seal service for preventing lubricating oil in a mechanism chamber (crank chamber) from ingressing into a cylinder space at the rear of the piston.

FIG. 8 shows a gas compressor/expander having a conventional seal device and comprising a housing 112 formed with a crank chamber 111, a cylinder 101 attached to the housing 112 for compressing or expanding a gas, and a piston 102 housed in the cylinder 101 reciprocatingly movable and connected to a crank mechanism (not shown) within the crank chamber 111 by a piston rod 103, cross guide 104 and connecting rod 105. The piston rod 103 extends through a partition wall 99 separating a space 106 at the rear of the piston from the crank chamber 111 and is provided with a seal member 107 for preventing lubricating oil in the crank chamber 111 from ingressing into the rear space 106.

Used as the seal member 107 is a lip-type seal member having a U-shaped section and a higher sealing property against a flow from the crank chamber 111 to the rear space 106 than against the opposite flow. Unlike seal members having no directionality in sealing property, such as slipper seals having a resin ring on the slidable face, lip-type seal members have an excellent sealing property in one direction and are widely used in hydraulic mechanisms, etc.

However, unlike the hydraulic mechanism wherein one side of the seal member is always in contact with lubricating oil, the gas compressor/expander is not designed to positively supply lubricating oil from the crank chamber toward the seal member so as to prevent ingress of the lubricating oil into the working space to the greatest possible extent, presenting the problem that marked wear occurs on the seal member.

Although countermeasures are therefore taken as by applying grease or like lubricant on the contact face of the seal member in advance, the lubricant applied to the seal member is gradually removed by reciprocating strokes of the piston rod, so that the seal member still wears away markedly to entail the problem of shortening the life of the machine. Especially in the case where the seal member is directional in sealing property, the grease or like lubricant applied initially is scraped off toward the side of lower sealing property with the reciprocating movement of the piston rod to result in a noticeably impaired life.

On the other hand, JP-A No. 87854/1989 discloses a seal device, as shown in FIG. 9 herein, and comprising a seal member 107 provided, at one side thereof toward a piston 102, with an intermediate chamber 108, and a second seal member 109 opposite to the seal member 107 in the directionality of sealing property and positioned between the intermediate chamber 108 and the piston 102. With this seal device, the intermediate chamber 108 is maintained at an internal pressure equivalent to the lowest pressure of a space 106 at the rear of the piston, so that the internal pressure of a crank chamber 111 is always higher than that of the intermediate chamber 108, whereby the seal member 107 is tightly pressed into contact with the outer periphery of a piston rod 103 to exhibit a high sealing property.

We have found by experiments that seal members, such as lip-type seal members, having directionality in sealing property act to send gas toward the direction of lower sealing property. With the seal device of FIG. 9, accordingly, this action lowers the pressure of the internal chamber 108 further below the lowest pressure of the piston rear space 106. When the pressure difference between the crank chamber 111 and the intermediate chamber 108 increases considerably during a continuous operation, the seal member 107 is pressed against the outer periphery of the piston rod 103 with an excessive pressure due to the pressure difference to cause marked wear on the seal member 107. This results in the problem that lubricating oil ingresses into the intermediate chamber 108 from the crank chamber 111 and further into the rear space 106.

Further, if the pressure difference between the highest pressure of the piston rear space 106 and the pressure of the intermediate chamber 108 increases considerably with a continued operation, the pressure difference causes the working gas to gradually leak out of the rear space 106 onto the crank chamber 111 via the intermediate chamber 108, consequently entailing the problem of impairing the ability of the gas compressor/expander.

In view of the foregoing problems encountered with the gas compressor/expander including a seal member which has a higher sealing property against a flow from the mechanism chamber (crank chamber) toward the piston rear space than against a flow in the opposite direction, an object of the present invention is to give a longer life to the seal member by minimizing the wear on the seal member and to prevent impairment of the performance of the gas compressor/expander by minimizing the leakage of the working gas from the rear space into the mechanism chamber.

DISCLOSURE OF THE INVENTION

The present invention provides a gas compressor-expander which has a space in the rear of a piston within a cylinder for compressing or expanding a gas, and a mechanism chamber provided with a power transmission disposed therein, a partition wall being provided between the piston rear space and the mechanism chamber and having a rod slidably extending therethrough for interconnecting the piston and the power transmission and a seal device surrounding the rod, the seal device comprising:

a first seal member 93 having a higher sealing property against a flow from the mechanism chamber toward the piston rear space 21 than against a flow in the opposite direction for preventing lubricating oil in the mechanism chamber from ingressing into the piston rear space, an intermediate chamber 91 provided in the vicinity of the first seal member 93 at one side thereof toward the piston rear space and forming around the rod 22 an annular space having a radial dimension larger than the thickness of a lubricating oil film formed on a surface of the rod, a second seal member 95 disposed in the vicinity of the intermediate chamber 91 at one side thereof toward the piston rear space for preventing working gas in the piston rear space from ingressing into the intermediate chamber 91, and a communication channel 96 for causing the intermediate chamber 91 and the mechanism chamber to communicate with each other.

In the gas compressor-expander of the present invention described, the intermediate chamber 91 and the mechanism chamber are held in communication with each other by the communication channel 96, whereby the intermediate chamber 91 is maintained at approximately the same pressure as the mechanism chamber. This eliminates the likelihood that the pressure difference between the intermediate chamber 91 and the mechanism chamber will become excessive, permitting sliding contact of the first seal member 93 with the outer periphery of the rod 22 under a suitable pressure. As a result, the first seal member 93 exhibits a satisfactory sealing effect to prevent the lubricating oil in the mechanism chamber from ingressing into the piston rear space 21 and to diminish the wear on the first seal member 93, consequently obviating leakage of the working gas from the rear space 21 into the mechanism chamber and preventing impairment of the capacity of the gas compressor-expander.

Incidentally, even if lubricating oil from the mechanism chamber is left unremoved by the first seal member 93 and forms an oil film around the rod 22, the oil film becomes discontinuous in the intermediate chamber 91. This obviates the likelihood of the lubricating oil ingressing into the piston rear space 21.

Filter means, when provided at an intermediate portion of the communication channel 96, precludes the lubricating oil, lubricating oil vapor, water vapor, etc. within the mechanism chamber from ingressing into the intermediate chamber 91 by way of the channel 96.

With the gas compressor-expander having the seal device of the invention described, wear on the seal member is minimized to give a prolonged life to the seal device, and the leakage of the working gas from the piston rear space into the mechanism chamber is minimized to prevent impairment of the ability of the compressor-expander.

Preferably, a lip-type seal member is used as the first seal member 93, whereby a high sealing effect is available against a flow from the mechanism chamber toward the piston rear space. The second seal member 95 can be a seal member having no directionality in sealing property, which diminishes an excessive pressure drop of the intermediate chamber 91 due to the gas sending action of the second seal member 95.

According to a specific embodiment, the communication channel 96 is provided at an intermediate portion thereof with opening-closing means, e.g., a pressure control valve 98, for permitting passage of the working gas upon the pressure difference between the intermediate chamber and the mechanism chamber exceeding a predetermined value.

According to the specific embodiment, the opening-closing means operates to maintain the pressure of the mechanism chamber at a level higher than that of the intermediate chamber by the predetermined value, consequently holding the first seal member 93 in intimate contact with the outer periphery of the rod 22 under a suitable pressure for the seal member to produce a satisfactory sealing effect.

The present invention provides another sealing device comprising:

a first seal member 901 having a higher sealing property against a flow from a mechanism chamber toward a space 21 in the rear of a piston than against a flow in the opposite direction for preventing lubricating oil in the mechanism chamber from ingressing into the piston rear space, an intermediate chamber 902 provided in the vicinity of the first seal member 901 at one side thereof toward the mechanism chamber and forming an annular space around a rod, a second seal member 905 provided in the vicinity of the intermediate chamber 902 at one side thereof toward the mechanism chamber and having a higher sealing property against the flow from the piston rear space toward the mechanism chamber than against the flow in the opposite direction, and an oil reservoir 903 provided between the second seal member 905 and the intermediate chamber 902 and capable of holding the lubricating oil to be sent in from the mechanism chamber, the distance from the oil reservoir 903 to the first seal member 901 being smaller than the stroke length of the rod 22.

With the gas compressor-expander having the seal device of the invention described, a specified amount of lubricating oil is collected in the oil reservoir 903 by the reciprocating movement of the rod 22, and the rod 22 reciprocatingly moves in the oil reservoir 903, whereby the lubricating oil is supplied to the sliding surfaces of the first seal member 901 and the rod 22. This minimizes wear on the first seal member 901, giving a prolonged life to the seal device.

Preferably, the oil reservoir 903 is held in communication with the mechanism chamber by an oil return channel 904, through which an excess of the lubricating oil sent into the reservoir 903 is returned to the mechanism chamber.

When the device described is used, the lubricating oil from the mechanism chamber will not be collected in the oil reservoir 903 in a quantity more than is necessary, with the result that an oil film of suitable thickness can be formed on the outer periphery of the rod.

Further preferably, a lip-type seal member is used as the first seal member 901 and/or the second seal member 905. The first seal member of the lip type produces a high sealing effect against the flow from the mechanism chamber toward the piston rear space. Further the lip-type seal serving as the second seal member affords a high sealing effect against the flow from the piston rear space toward the mechanism chamber.

BEST MODE OF CARRYING OUT THE INVENTION

The present invention as applied to displacer-type Stirling chillers will be described below with reference to the drawings.

FIRST EMBODIMENT

Figure 1:
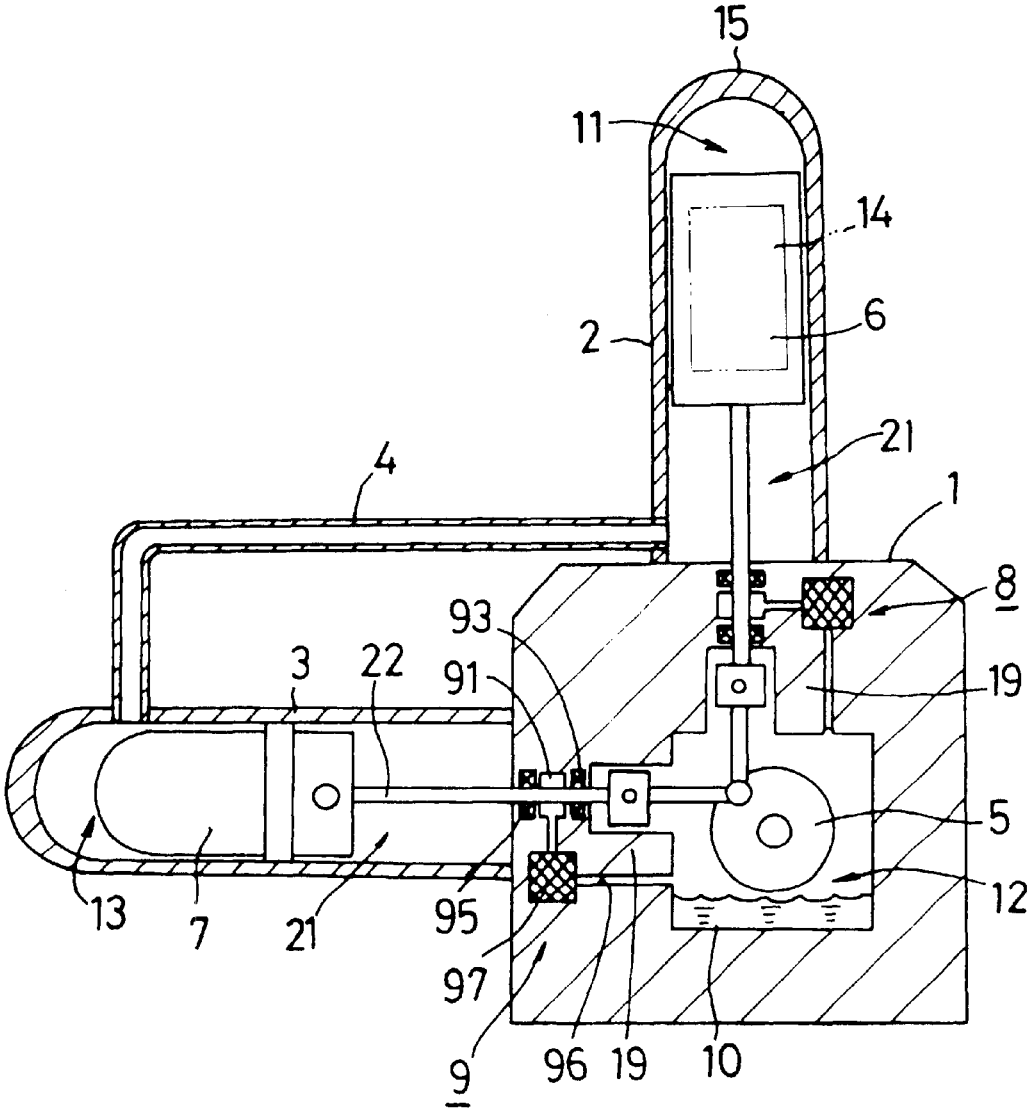
FIG. 1 is a view in section of a Stirling chiller incorporating seal devices embodying the invention.

With reference to FIG. 1 showing a Stirling chiller incorporating this embodiment, a housing 1 has attached thereto an expansion cylinder 2 and a compression cylinder 3 as positioned at an angle of 90 degrees with each other. An expansion piston (displacer) 6 enclosed in the expansion cylinder 2 and a compression piston 7 in the compression cylinder 3 are connected to a common crank mechanism 5 and reciprocatingly driven as displaced in phase by 90 degrees from each other.

The crank mechanism 5 is enclosed in a crank chamber 12 formed inside the housing 1. Lubricating oil 10 is placed in the bottom portion of the crank chamber 12.

The expansion piston 6 serves the function of a piston and also the function of a regenerative heat exchanger and is filled in its interior with a heat storage material 14 comprising, for example, a sintered metal. A working gas flowing into the piston 6 from one opening thereof undergoes heat exchange with the heat storage material 14 before flowing out of the other opening after passing through the material 14.

The interior of the expansion cylinder 2 and that of the compression cylinder 3 are separated from the crank chamber 12 by respective partition walls 19. A space 21 in the expansion cylinder 2 in the rear of the piston therein and a compression space 13 in the compression cylinder 3 are held in communication with each other by a gas channel 4, whereby the compression space 13 of the compression cylinder 3 and an expansion space 11 of the expansion cylinder 2 are caused to communicate with each other by the heat storage material 14 and the gas channel 4.

The partition walls 19 separating the respective piston rear spaces 21 from the crank chamber 12 are provided with the respective seal devices 8, 9 to be described below, each of the devices surrounding a piston rod 22.

The crank mechanism 5 of the Stirling chiller described is driven by an unillustrated drive motor, whereby the compression piston 7 and the expansion piston 6 are reciprocatingly moved as positioned out of phase by 90 degrees to provide Stirling cycles. More specifically stated, the compression piston 7 moves to compress the gas in the compression space 13 on the first stroke, causing the gas to flow into the expansion cylinder 2 through the gas channel 4 (isothermal compression). On the second stroke, the gas passes through the heat storage material 14 in the expansion piston 6 for heat exchange with the material 14 and is reduced in temperature (isovolumic cooling). The gas passing through the heat storage material 14 flows into the expansion space 11 of the expansion cylinder 2 on the third stroke and then expands with the descent of the expansion piston 6 (isothermal expansion). Subsequently on the fourth stroke, the gas in the expansion space 11 passes through the heat storage material 14 for heat exchange with the material 14 with the ascent of the expansion piston 6 for a rise in temperature and thereafter flows into the compression space 13 again through the gas channel 4 (isovolumic heating).

The first to fourth strokes are repeated to cool a cold heat 15 provided at the top of the expansion cylinder 2.

Figure 2:
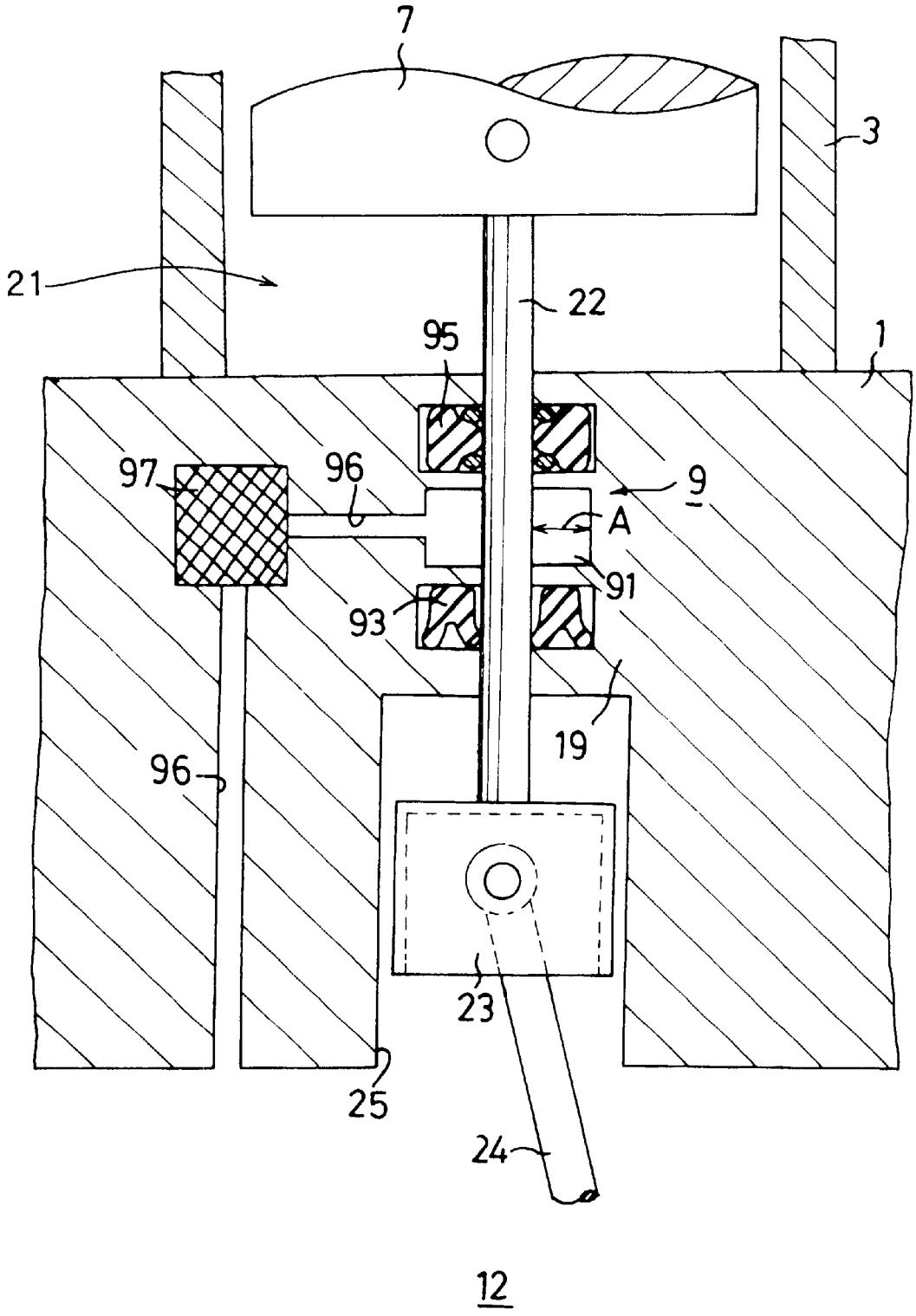
FIG. 2 is an enlarged view in section of the seal device.

Next, the construction of the seal devices 8, 9 will be described in detail with reference to FIG. 2. Although FIG. 2 shows one of the seal devices, 9, provided for the compression cylinder 3 of the Stirling chiller described, the other seal device 8 for the expansion cylinder 2 also has the same construction as will be described below.

The compression piston 7 within the compression cylinder 3 is connected to a connecting rod 24 by the piston rod 22 and a cross guide 23. The piston rod 22 extends through the partition wall 19 separating the piston rear space 21 from the crank chamber 12. The cross guide 23 is guided by a guide wall 25 of the housing 1 for a reciprocating motion.

The seal device 9 comprises a first seal member 93 of the lip type having a higher sealing property against a flow from the crank chamber 12 toward the piston rear space 21 than against a flow in the opposite direction, an annular intermediate chamber 91 provided in the vicinity of the first seal member 93 at one side thereof toward the piston rear space, a second seal member 95 of the T-ring type disposed in the vicinity of the intermediate chamber 91 at one side thereof toward the piston rear space and having no directionality in sealing property, a communication channel 96 for causing the intermediate chamber 91 and the crank chamber 12 to communicate with each other, and an oil filter 97 provided at an intermediate portion of the communication channel 96. The intermediate chamber 91 forms around the piston rod 22 an annular space having a radial dimension A larger than the thickness of the lubricating oil film to be formed on the rod surface.

The second seal member 95 used in the Stirling chiller has no directionality and therefore has no gas sending action. Moreover, the intermediate chamber 91 and the crank chamber 12 are held in communication with each other by the communication channel 96, whereby the intermediate chamber 91 is maintained at approximately the same pressure as the crank chamber 12 despite the gas sending action of the first seal member 93. This eliminates the likelihood that the pressure difference between the intermediate chamber 91 and the crank chamber 12 will become excessive, permitting pressing contact of the first seal member 93 with the outer periphery of the piston rod 22 under a suitable pressure. As a result, the first seal member 93 exhibits a satisfactory sealing effect to prevent the lubricating oil in the crank chamber 21 from ingressing into the piston rear space 21 and to diminish the wear on the first seal member 93.

The working gas is therefore unlikely to leak out of the piston rear space 21 into the crank chamber 12, preventing impairment of the refrigeration capacity of the Stirling chiller.

Incidentally, even if the lubricating oil from the crank chamber 12 remains unremoved by the first seal member 93, forming an oil film over the outer periphery of the piston rod 22, the surface of the oil film is out of contact with the inner peripheral surface of the intermediate chamber 91, so that the oil film will not ingress into the piston rear space 21 by virtue of capillarity but becomes discontinuous within the intermediate chamber 91.

The oil filter 97 provided in the communication channel 96 obviates the likelihood that lubricating oil vapor, water vapor and the like in the crank chamber 12 will ingress into the intermediate chamber 12 through the communication channel 96.

Furthermore, the gas sending action of the first seal member 93 of the lip type provides a gas recycling channel of intermediate chamber 91→crank chamber 12→communication channel 96→oil filter 97→communication channel 96→intermediate chamber 91, whereby the lubricating oil, water, etc. from the crank chamber 12 are prevented from passing through the first seal member 93 with the reciprocating movement of the piston rod 22. Even if ingressing into the intermediate chamber 91, the lubricating oil, etc. will be returned to the crank chamber 12 by the gas recycling action.

The second seal member 95 is not limited to the seal member of the T-ring type 95; various seal members are usable insofar as they are not directional in sealing property.

SECOND EMBODIMENT

Figure 3:
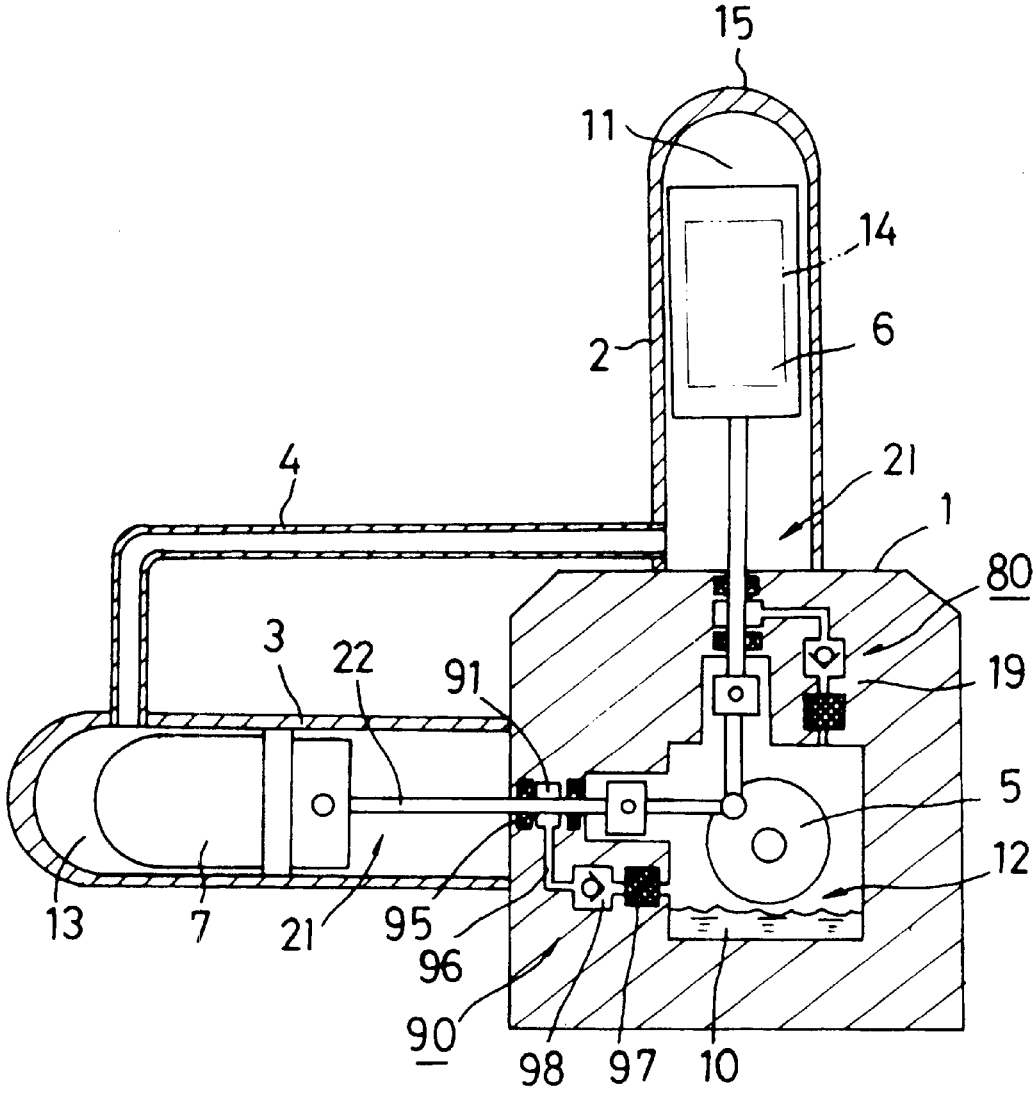
FIG. 3 is a view in section of a Stirling chiller incorporating other seal devices embodying the invention.

As shown in FIG. 3, a Stirling chiller incorporating this embodiment has the same construction as the foregoing Stirling chiller according to the first embodiment with the exception of the construction of seal devices 80, 90, so that throughout the first and second embodiments, like functional members are designated by like reference numerals.

Figure 4:
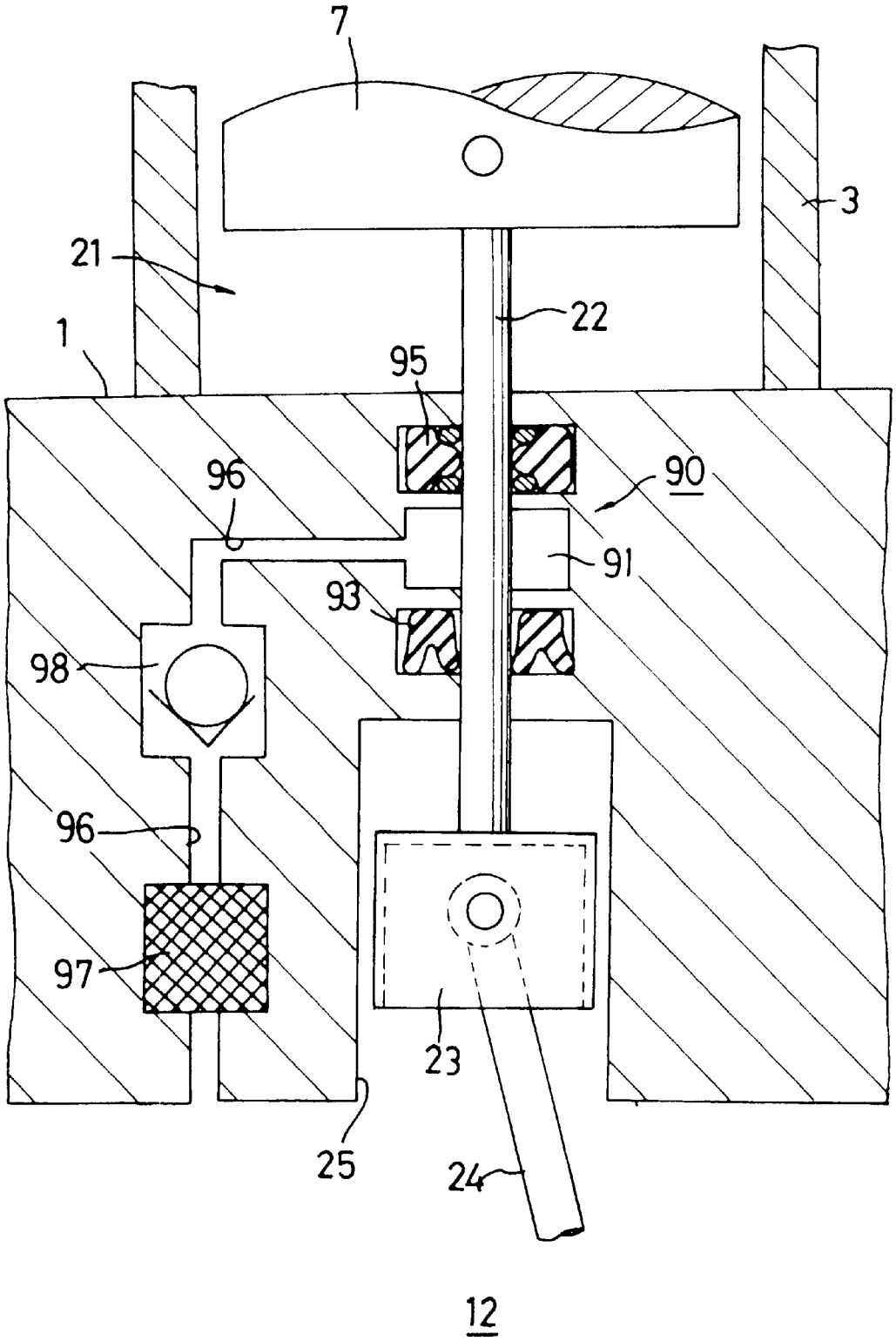
FIG. 4 is an enlarged view in section of the seal device.

The construction of the seal devices 80, 90 of the present embodiment will be described in detail with reference to FIG. 4. Although FIG. 4 shows one of the seal devices, 90, for the compression cylinder 3, the other seal device 80 for the expansion cylinder 2 is similar to the device 90 in construction.

The seal device 90 comprises a first seal member 93 of the lip type having a higher sealing property against a flow from the crank chamber 12 toward the piston rear space 21 than against a flow in the opposite direction, an annular intermediate chamber 91 provided in the vicinity of the first seal member 93 at one side thereof toward the piston rear space, a second seal member 95 disposed in the vicinity of the intermediate chamber 91 at one side thereof toward the piston rear space and having no directionality in sealing property, a communication channel 96 for causing the intermediate chamber 91 and the crank chamber 12 to communicate with each other, and an oil filter 97 provided at an intermediate portion of the communication channel 96. Although having the same arrangement of these components as the seal device 9 of the first embodiment, the seal device 90 has a pressure control valve 98 at an intermediate portion of the communication channel 96.

The pressure control valve 98 opens when the pressure of the crank chamber 12 increases to a value at least 2 atm. higher than the pressure of the intermediate chamber 91. The opening-closing operation of the valve 98 maintains the pressure of the crank chamber 12 at a level 2 atm. higher than the pressure of the intermediate chamber 91.

This holds the first seal member 93 in pressing contact with the outer periphery of the piston rod 22 under a suitable pressure, enabling the seal member to produce a higher sealing effect than the first seal member 93 of the first embodiment.

The present embodiment otherwise has the same advantage as the first.

Incidentally, an electrically operable valve, one-way valve or the like is usable in place of the pressure control valve 98 so as to permit the movement of the working gas upon the internal pressure of the intermediate chamber 91 increasing to a level higher than that of the crank chamber 21 by a specified value.

THIRD EMBODIMENT

Figure 5:
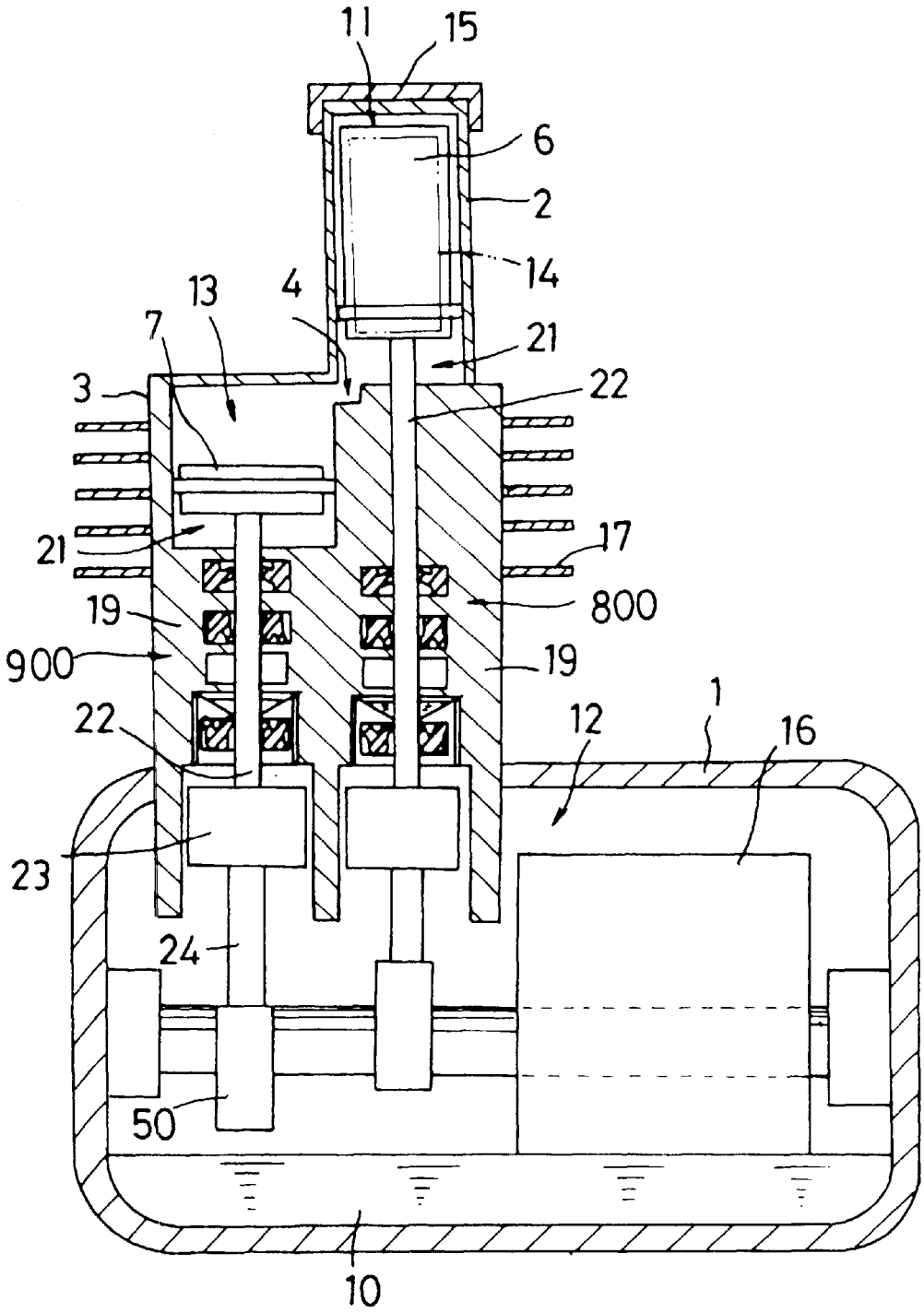
FIG. 5 is a view in section of a Stirling chiller incorporating still other seal devices embodying the invention.

FIG. 5 shows a Stirling chiller incorporating this embodiment and comprising an expansion cylinder 2 and a compression cylinder 3 which are mounted vertically in combination by partition walls 19 on an upper portion of a housing 1. An expansion piston (displacer) 6 enclosed in the expansion cylinder 2 and a compression piston 7 in the compression cylinder 3 are connected to a common crank mechanism 50 and reciprocatingly driven as displaced in phase by 90 degrees from each other.

The crank mechanism 50 is enclosed in a crank chamber 12 formed inside the housing 1 and coupled to a drive motor 16. Lubricating oil 10 is placed in the bottom portion of the crank chamber 12.

The interior of the expansion cylinder 2 and that of the compression cylinder 3 are separated from the crank chamber 12 by the respective partition walls 19. A space 21 in the expansion cylinder 2 in the rear of the piston therein and a compression space 13 in the compression cylinder 3 are held in communication with each other by a gas channel 4, whereby the compression space 13 of the compression cylinder 3 and an expansion space 11 of the expansion cylinder 2 are caused to communicate with each other by a heat storage material 14 and the gas channel 4.

The partition walls 19 separating the respective piston rear spaces 21 from the crank chamber 12 are provided with respective seal devices 800, 900 each surrounding a piston rod 22.

Figure 6:
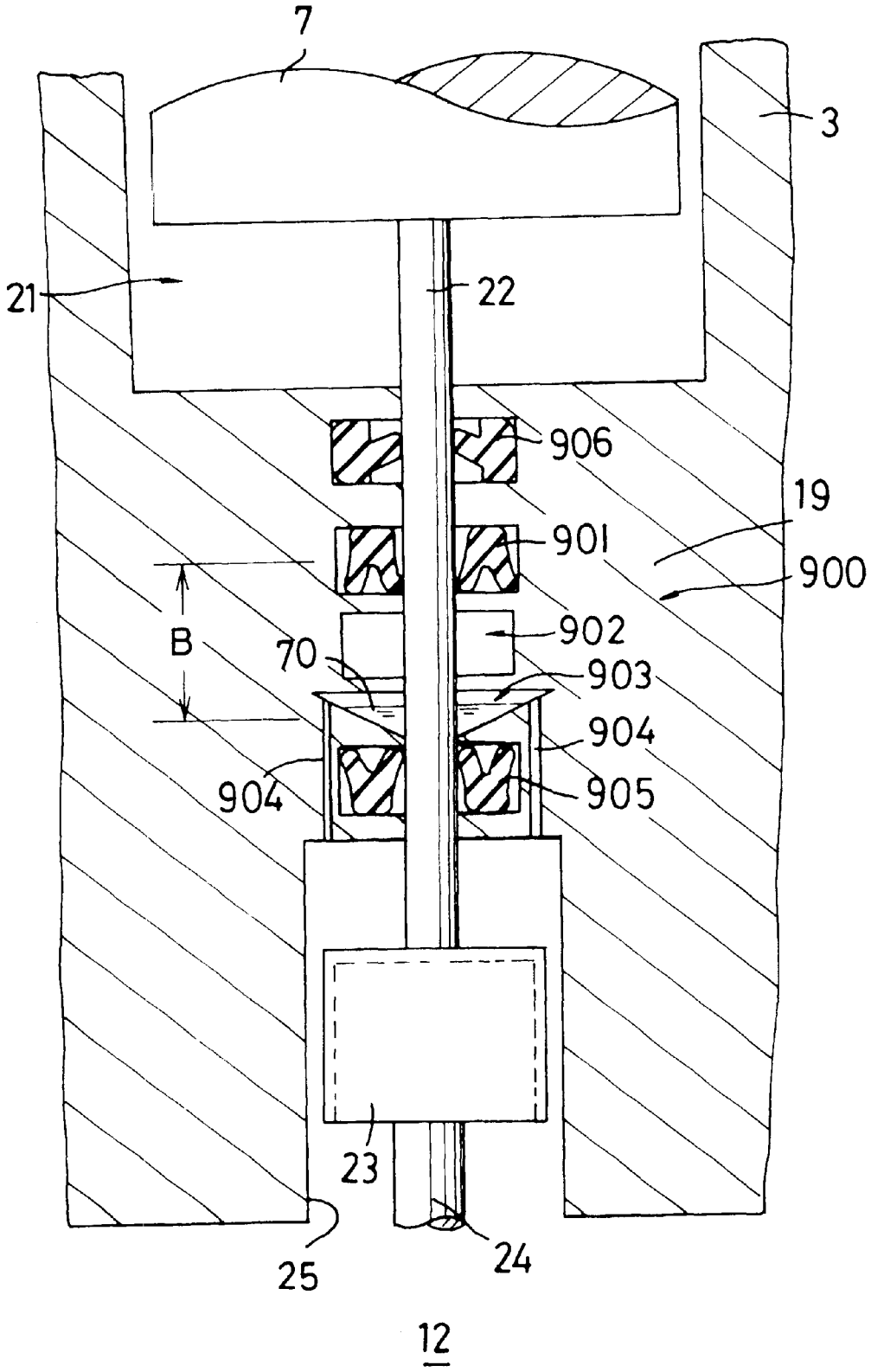
FIG. 6 is an enlarged view in section of the seal device.

Next, the construction of the seal devices 800, 900 will be described in detail with reference to FIG. 6. Although FIG. 6 shows one of the seal devices, 900, provided for the compression cylinder 3 of the Stirling chiller described, the other seal device 800 for the expansion cylinder 2 also has the same construction as will be described below.

The compression piston 7 within the compression cylinder 3 is connected to a connecting rod 24 by the piston rod 22 and a cross guide 23. The piston rod 22 extends through the partition wall 19 separating the piston rear space 21 from the crank chamber 12. The cross guide 23 is guided by a guide wall 25 of the housing 1 for a reciprocating motion.

The seal device 900 comprises a first seal member 901 of the lip type having a higher sealing property against a flow from the crank chamber 12 toward the piston rear space 21 than against a flow in the opposite direction, an annular intermediate chamber 902 provided in the vicinity of the first seal member 901 at one side thereof toward the crank chamber 12, a second seal member 905 of the lip type disposed in the vicinity of the intermediate chamber 902 at one side thereof toward the crank chamber 12 and opposite to the first seal member 901 in the directionality of sealing property, an oil reservoir 903 in the form of an inverted frustum of a cone and provided between the second seal member 905 and the intermediate chamber 902, and a third seal member 906 of the T-ring type disposed in the vicinity of the second intermediate chamber 908 at one side thereof toward the piston rear space 21. The distance B from the oil reservoir 903 to the first seal member 901 is smaller than the stroke length of the piston rod 22. The oil reservoir 903 communicates with the crank chamber 12 through an oil return channel 904.

The first seal member 901 of the Stirling chiller described exhibits a high sealing effect against the flow from the crank chamber 12 toward the piston rear space 21.

Further since the second seal member 905 has a high sealing property against the flow from the piston rear space 21 toward the crank chamber 12, this directionality forwards the lubricating oil 10 from the crank chamber 12 into the oil reservoir 903, and an excess of the oil is returned to the crank chamber 12 via the oil return channel 904. Consequently, the lubricating oil 10 is held in the oil reservoir 903 in a constant quantity at all times.

When the piston rod 22 reciprocatingly moves in the oil reservoir 903, the lubricating oil 10 adhering to the outer periphery of the rod 22 is supplied to the surface of the first seal member 901 in sliding contact with the piston rod 22 by the movement of the rod, lubricating the surface and thereby diminishing wear on the first seal member 901.

Because the intermediate chamber 902 is provided between the oil reservoir 903 and the first seal member 901, the lubricating oil 10 collecting in the reservoir 903 will not be applied directly to the first seal member 901 with the reciprocating movement of the piston rod 22 and is unlikely to be supplied to the first seal member 901 in an excessive amount. Moreover, the third seal member 906 disposed in the vicinity of the first seal member 901 on the side thereof toward the piston rear space 21 eliminates the likelihood that the lubricating oil fill ingress into the space 21.

The first and second seal members 901, 905 are not limited to lip-type seal members; various seal members are usable insofar as they have the directionality described above.

FOURTH EMBODIMENT

Figure 7:
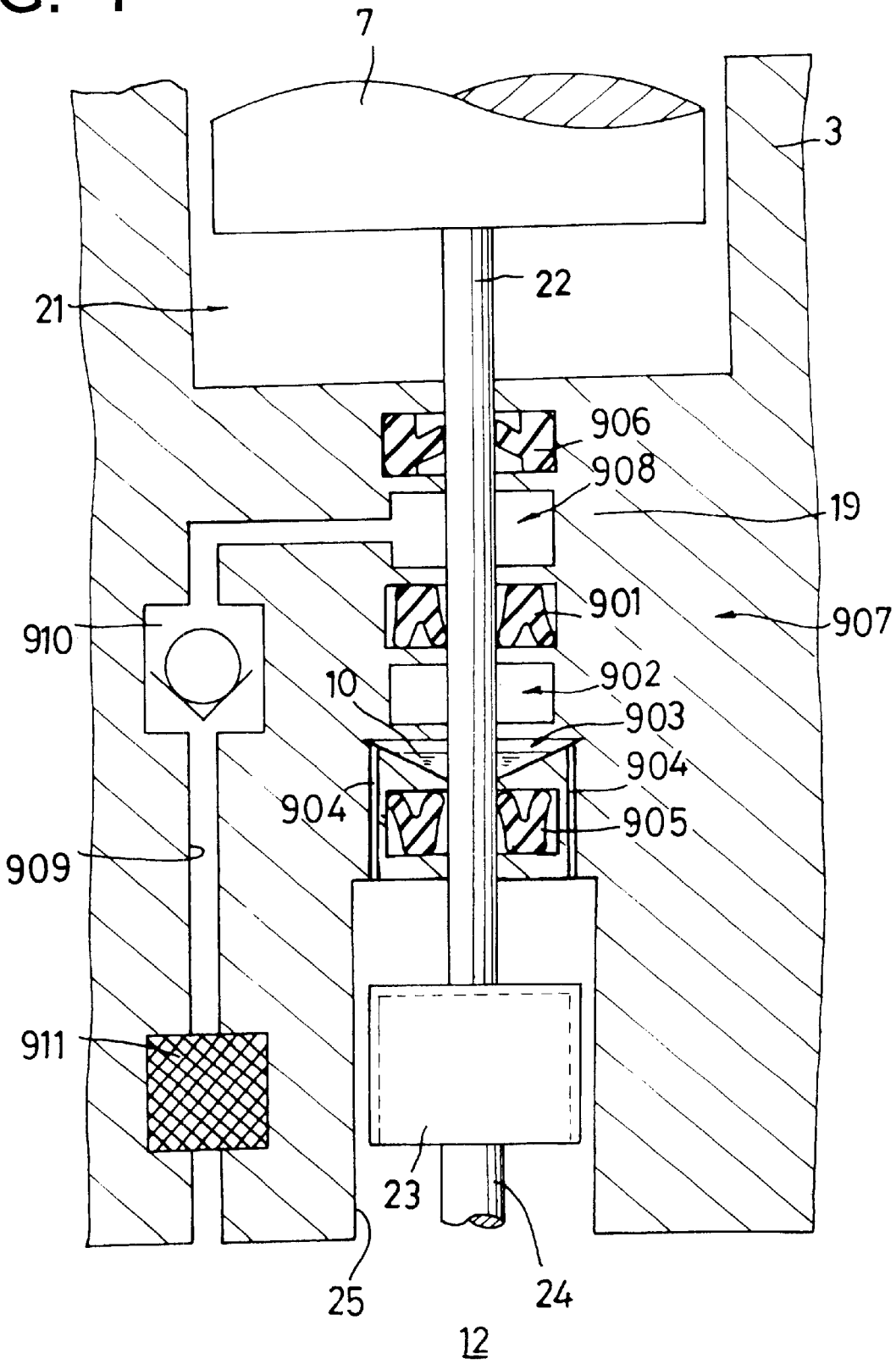
FIG. 7 is an enlarged view in section of the construction of another seal device.
Figure 8:
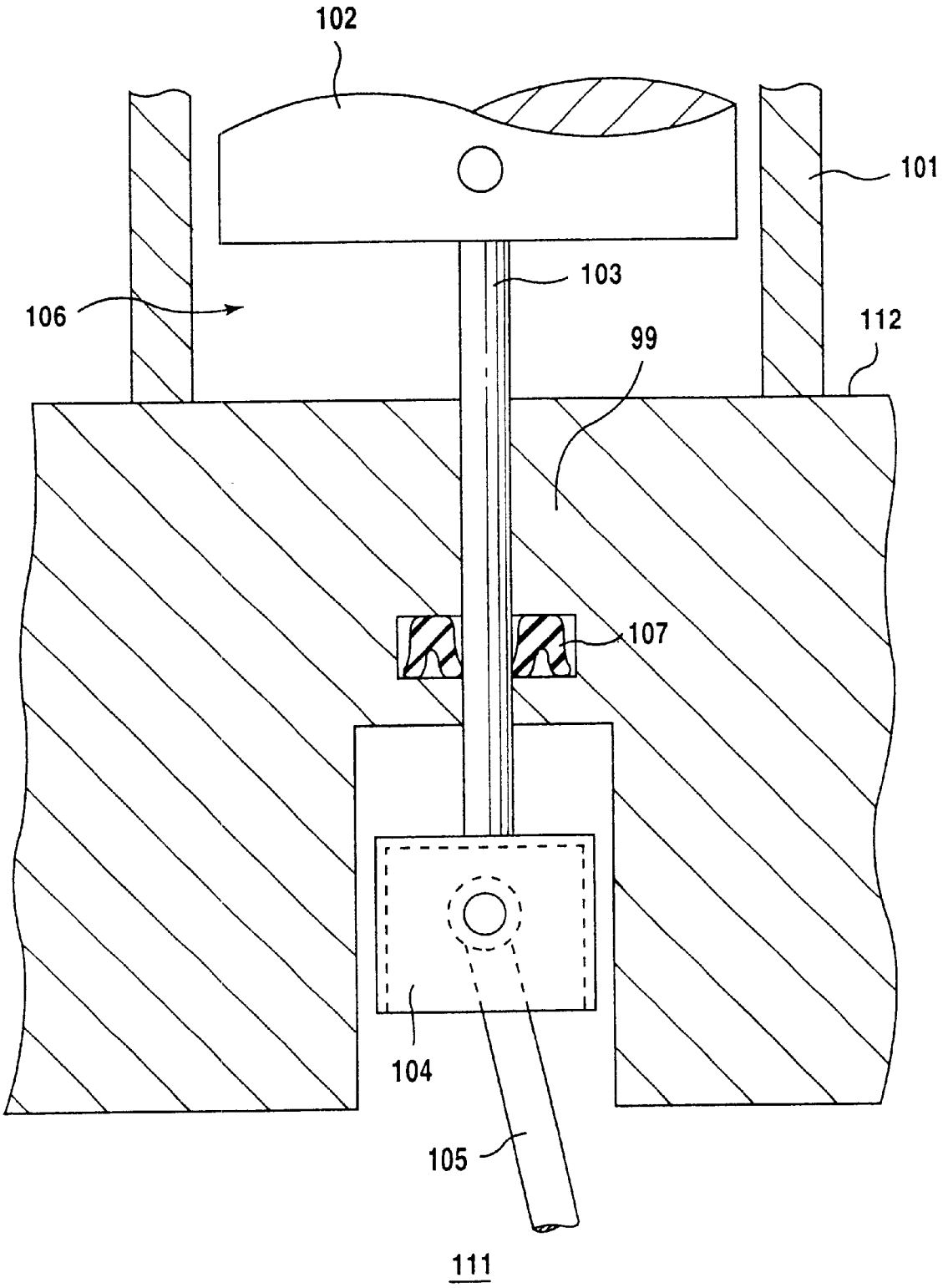
FIG.8 PRIOR ART
FIG. 8 is a view in section showing a conventional seal device.
Figure 9:
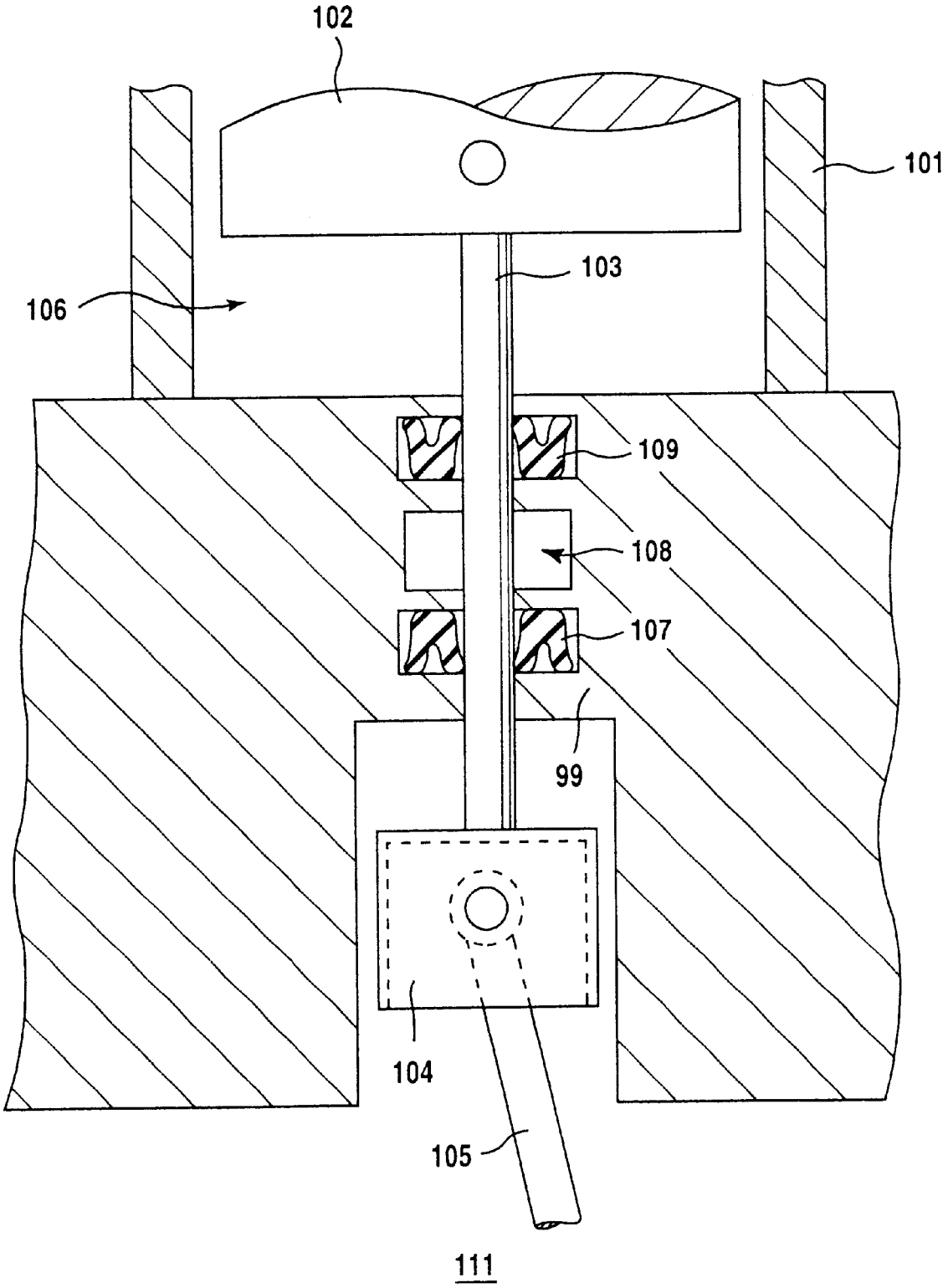
FIG.9 PRIOR ART
FIG. 9 is a view in section showing another conventional seal device.

The seal device of this embodiment incorporated in a Stirling chiller comprises the construction of seal device 900 of the third embodiment described and the construction of seal device 90 of the foregoing second embodiment in combination therewith as seen in FIG. 7.

More specifically, the seal device 907 of this embodiment has a second intermediate chamber 908 disposed between a first seal member 901 and a third seal member 906 and similar to the one included in the second embodiment. The second intermediate chamber 908 communicates with a crank chamber 12 via a communication channel 909. The communication channel 909 is provided with a pressure control valve 910 and an oil filter 911 as in the second embodiment.

Accordingly, the fourth embodiment has the advantage of the second embodiment that the pressure control valve 910 maintains the pressure difference between the second intermediate chamber 908 and the crank chamber 12 at about 2 atm., enabling the first seal member 901 to produce a suitable sealing effect and. at the same time, the advantage of the third embodiment that the first seal member 901 is supplied with lubricating oil 10 from an oil reservoir 903 and diminished in wear.

The device of the present invention is not limited to the foregoing embodiments in construction but can be modified variously without departing from the spirit of the invention as set forth in the appended claims. The present invention is of course applicable not only to Stirling chillers but also to Stirling engines and other gas compressor-expanders.

What is claimed is:

1. A gas compressor-expander having a space in the rear of a piston within a cylinder for compressing or expanding a gas, and a mechanism chamber provided with a power transmission therein, a partition wall being provided between the piston rear space and the mechanism chamber and having a rod slidably extending therethrough for interconnecting the piston and the power transmission and a seal device surrounding the rod, the gas compressor-expander being characterized in that the seal device comprises:

a first seal member having a higher sealing property against a flow from the mechanism chamber toward the piston rear space than against a flow in the opposite direction for preventing lubricating oil in the mechanism chamber from ingressing into the piston rear space, an intermediate chamber provided adjacent the first seal member at a side thereof toward the piston rear space and forming around the rod an annular space having a radial dimension larger than the thickness of a lubricating oil film formed on a surface of the rod, a second seal member disposed adjacent the intermediate chamber at a side thereof toward the piston rear space for preventing working gas in the piston rear space from ingressing into the intermediate chamber, and a communication channel extending between the intermediate chamber and the mechanism chamber to cause the chambers to communicate with each other for sending gas through said channel from the mechanism chamber into the intermediate chamber.

2. A gas compressor-expander according to claim 1 wherein the communication channel is provided at an intermediate portion thereof with filter means for preventing passage of the lubricating oil, lubricating oil vapor or water vapor.

3. A gas compressor-expander according to claim 1 wherein the first seal member is a lip-type seal member.

4. A gas compressor-expander according to claim 1 wherein the second seal member is a seal member having no directionality in sealing property.

5. A gas compressor-expander according to claim 1 wherein the communication channel is provided with opening-closing means at an intermediate portion thereof operative to permit passage of the working gas upon the occurrence of a pressure difference between the intermediate chamber and the mechanism chamber exceeding a predetermined value.

6. A gas compressor-expander according to claim 5 wherein the opening-closing means is a pressure control valve.

7. A gas compressor-expander having a space in the rear of a piston within a cylinder for compressing or expanding a gas, and a mechanism chamber provided with a power transmission therein, a partition wall being provided between the piston rear space and the mechanism chamber and having a rod slidably extending therethrough for interconnecting the piston and the power transmission, and a seal device surrounding the rod, said seal device comprising:

a first seal member having a higher sealing property against a flow from the mechanism chamber toward the piston rear space than against a flow in the opposite direction for preventing lubricating oil in the mechanism chamber from ingressing into the piston rear space, an intermediate chamber provided adjacent the first seal member at a side thereof toward the mechanism chamber and forming an annular space around the rod, a second seal member provided adjacent the intermediate chamber at a side thereof toward the mechanism chamber and having a higher sealing property against the flow from the piston rear space toward the mechanism chamber than against the flow in the opposite direction, and an oil reservoir provided between the second seal member and the intermediate chamber and being operative to hold lubricating oil received from the mechanism chamber, the distance from the oil reservoir to the first seal member being smaller than the stroke length of the rod.

8. A gas compressor-expander according to claim 7 including an oil return channel extending between the oil reservoir and the mechanism chamber, whereby an excess of lubricating oil admitted to the oil reservoir is returned to the mechanism chamber through the oil return channel.

9. A gas compressor-expander according to claim 7 wherein at least one of said seal members comprises a lip-type seal member.

10. A gas compressor-expander having a space in the rear of a piston within a cylinder for compressing or expanding a gas, and a mechanism chamber provided with a power transmission therein, a partition wall being provided between the piston rear space and the mechanism chamber and having a rod slidably extending therethrough for interconnecting the piston and the power transmission, and a seal device surrounding the rod, the gas compressor-expander, said seal device comprising:

a first seal member having a higher sealing property against a flow from the mechanism chamber toward the piston rear space than against a flow in the opposite direction for preventing lubricating oil in the mechanism chamber from ingressing into the piston rear space, a first intermediate chamber provided adjacent the first seal member at a side thereof toward the mechanism chamber and forming an annular space around the rod, a second seal member provided adjacent the first intermediate chamber at a side thereof toward the mechanism chamber and having a higher sealing property against the flow from the piston rear space toward the mechanism chamber than against the flow in the opposite direction, an oil reservoir provided between the second seal member and the first intermediate chamber and operative to hold lubricating oil received from the mechanism chamber, a second intermediate chamber provided adjacent the first seal member at a side thereof toward the piston rear space and forming around the rod an annular space having a radial dimension larger than the thickness of a lubricating oil film formed on a surface of the rod, a third seal member disposed adjacent the second intermediate chamber at a side thereof toward the piston rear space for preventing working gas in the piston rear space from ingressing into the second intermediate chamber, and a communication channel extending between the second intermediate chamber and the mechanism chamber to cause the chambers to communicate with each other for sending gas through said channel from the mechanism chamber into the second intermediate chamber therethrough, the distance from the oil reservoir to the first seal member being smaller than the stroke length of the rod.

* * * * *